US010405119B2

(12) United States Patent
Hiraoka

(10) Patent No.: US 10,405,119 B2
(45) Date of Patent: Sep. 3, 2019

(54) LOUDSPEAKER-DIAPHRAGM AND LOUDSPEAKER INCLUDING THE SAME

(71) Applicant: Panasonic Intellectual Property Management Co., Ltd., Osaka (JP)

(72) Inventor: Hidetoshi Hiraoka, Kyoto (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 67 days.

(21) Appl. No.: 15/889,286

(22) Filed: Feb. 6, 2018

(65) Prior Publication Data

US 2018/0270597 A1 Sep. 20, 2018

(30) Foreign Application Priority Data

Mar. 16, 2017 (JP) ..... 2017-050680

(51) Int. Cl.

| | |
|---|---|
| ***H04R 31/00*** | (2006.01) |
| ***H04R 7/18*** | (2006.01) |
| ***H04R 7/12*** | (2006.01) |
| ***H04R 9/02*** | (2006.01) |
| ***H04R 1/28*** | (2006.01) |
| ***H04R 9/06*** | (2006.01) |

(52) U.S. Cl.

CPC ..... *H04R 31/003* (2013.01); *H04R 1/288* (2013.01); *H04R 7/127* (2013.01); *H04R 7/18* (2013.01); *H04R 9/025* (2013.01); *H04R 9/06* (2013.01); *H04R 2307/023* (2013.01); *H04R 2400/11* (2013.01)

(58) Field of Classification Search

None

See application file for complete search history.

(56) References Cited

U.S. PATENT DOCUMENTS

| | | | | |
|---|---|---|---|---|
| 8,284,967 | B2 * | 10/2012 | Yang | H04R 19/02 381/191 |
| 2006/0147081 | A1 * | 7/2006 | Mango, III | H04R 7/125 381/398 |
| 2009/0010471 | A1 * | 1/2009 | Okazaki | H04R 7/16 381/354 |
| 2009/0074228 | A1 * | 3/2009 | Mango, III | H04R 31/003 381/432 |

(Continued)

FOREIGN PATENT DOCUMENTS

| | | |
|---|---|---|
| JP | 3-085100 | 4/1991 |
| JP | 7-101957 B | 11/1995 |

OTHER PUBLICATIONS

Worner, E, et al, "Diamond loudspeaker cones for high-end audio components." pp. 1-9. 2006. (Year: 2006).*

*Primary Examiner* — Curtis A Kuntz
*Assistant Examiner* — Qin Zhu
(74) *Attorney, Agent, or Firm* — Greenblum & Bernstein, P.L.C.

(57) ABSTRACT

A loudspeaker diaphragm includes a main material containing molecules each having a hydroxyl group, and a diamondoid derivative. The diamondoid derivative contains molecules each having two or more hydrogen-bonding functional groups. Each of the two or more hydrogen-bonding functional groups in each of the molecules of the diamondoid derivative is bonded to the hydroxyl group in each of the molecules of the main material.

6 Claims, 3 Drawing Sheets

(56) References Cited

U.S. PATENT DOCUMENTS

| | | | | |
|---|---|---|---|---|
| 2015/0200039 | A1* | 7/2015 | Taguchi | C08L 21/00<br>310/363 |
| 2016/0014526 | A1* | 1/2016 | Miyoshi | H01L 41/183<br>381/190 |
| 2018/0355486 | A1* | 12/2018 | Cojocaru | C23C 18/2006 |

* cited by examiner

LOUDSPEAKER-DIAPHRAGM AND LOUDSPEAKER INCLUDING THE SAME

BACKGROUND

1. Technical Field

The present disclosure relates to a loudspeaker diaphragm and a loudspeaker for various audio devices.

2. Description of the Related Art

Loudspeaker diaphragms are roughly classified into cellulose diaphragms and resin ones. Cellulose diaphragms are produced by subjecting cellulose fibers to a paper-making process, whereas resin diaphragms are produced by injecting resin into a mold. Some kinds of loudspeakers are used under severe conditions, such as in a vehicle engine compartment or in a vehicle interior. Most of such loudspeakers include a resin diaphragm made from polypropylene as base resin in terms of waterproofness, cost, and specific gravity. Polypropylene is a kind of thermoplastic resin.

Japanese Unexamined Patent Application Publication No. H03-85100 (hereinafter, Patent Literature 1) discloses the following loudspeaker diaphragms (1) and (2):

(1) A loudspeaker diaphragm produced by accumulating ceramic powder or metal powder onto a diaphragm base formed by molding a molybdenum foil or a polyimide resin film, and depositing a diamond film layer onto the surface of the accumulated powder.

(2) A loudspeaker diaphragm produced by removing the above-mentioned diaphragm base after the deposition of the diamond film layer.

Meanwhile, Japanese Patent No. H07-101957 (hereinafter, Patent Literature 2) discloses the following loudspeaker diaphragms (3) to (5):

(3) A loudspeaker diaphragm produced by depositing a diamond layer onto a diaphragm base, and then removing the diaphragm base.

(4) A loudspeaker diaphragm produced by depositing a mixture layer containing diamond-like carbon and diamond onto a diaphragm base, and then removing the diaphragm base.

(5) A loudspeaker diaphragm produced by depositing a diamond layer onto a diaphragm base, depositing a diamond-like carbon layer onto the diamond layer, depositing a diamond layer onto the diamond-like carbon layer, and removing the diaphragm base.

SUMMARY

The present disclosure provides a loudspeaker diaphragm having a high modulus of elasticity and light weight, and a loudspeaker including such a diaphragm.

The loudspeaker diaphragm according to the present disclosure includes a main material containing molecules each having a hydroxyl group, and a diamondoid derivative containing molecules each having two or more hydrogen-bonding functional groups. Each of the two or more hydrogen-bonding functional groups in each of the molecules of the diamondoid derivative is bonded to the hydroxyl group in each of the molecules of the main material.

In this diaphragm, the molecule of the diamondoid derivative having two or more hydrogen-bonding functional groups is bonded to the molecules of the main material. This structure strengthens the bond between the molecules of the main material. Furthermore, the diamondoid derivative, which does not have high specific gravity, enables the diaphragm to have high modulus of elasticity while maintaining low specific gravity. As a result, a loudspeaker including such a diaphragm has excellent acoustic characteristics.

DETAILED DESCRIPTION OF PREFERRED EMBODIMENT

Prior to describing an exemplary embodiment of the present disclosure, problems with loudspeaker diaphragms known in the art will now be described briefly.

Improvement in acoustic characteristics of loudspeakers depends on balancing internal loss and specific modulus of elasticity of the diaphragm material. Cellulose diaphragms and resin ones known in the art are needed to be made of a material with high specific gravity in order to have high specific modulus of elasticity. However, the use of a material with high specific gravity results in heavier loudspeaker diaphragms, hindering the improvement of their acoustic characteristics. For example, the sound pressure level may be decreased.

In Patent Literature 1, diamond is not chemically bonded to the metal or resin used for the base in a strict sense, so that the effect is very limited. Meanwhile, in Patent Literature 2, the use of diamond itself as the diaphragm is too costly for practical use. Moreover, chemical vapor deposition (CVD) is the only applicable process to form the diaphragm, requiring large amounts of time to deposit diamond until it is thick enough as a diaphragm.

Figure 1:
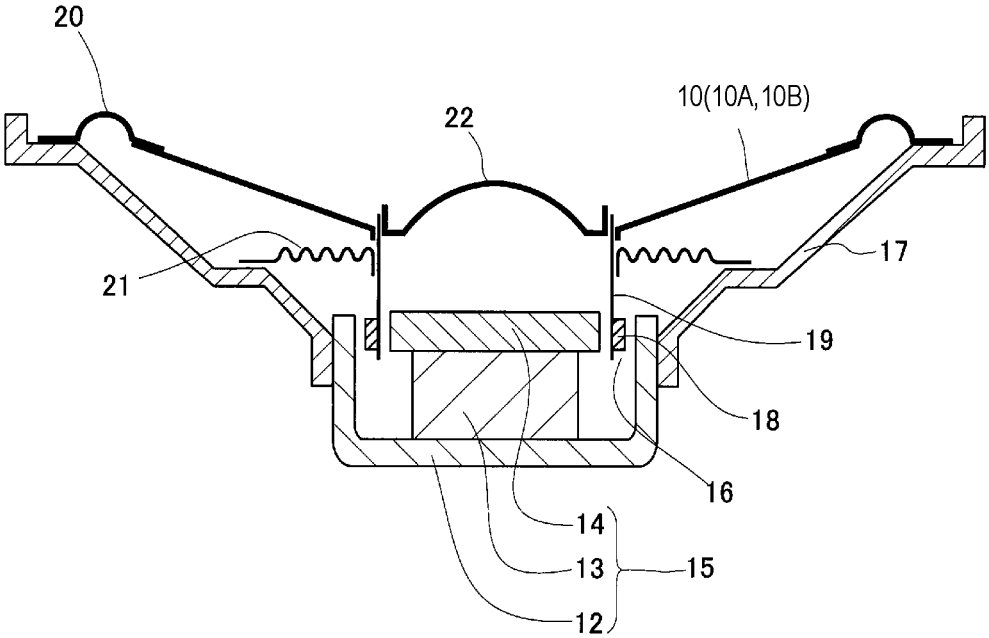
FIG. 1 is a sectional view of a loudspeaker including a loudspeaker diaphragm according to an exemplary embodiment of the present disclosure.

The exemplary embodiment of the present disclosure will now be described with reference to drawings. FIG. 1 is a sectional view of the loudspeaker according to the exemplary embodiment.

This loudspeaker includes edge 20, cone diaphragm 10, magnetic circuit 15, frame 17, voice coil 19, and damper 21. Edge 20 is coupled to the outer periphery of diaphragm 10. Magnetic circuit 15 includes yoke 12, magnet 13, and plate 14. Magnetic circuit 15 is provided with uniform magnetic gap 16 between the inner periphery of yoke 12 and the outer periphery of plate 14. Frame 17 is attached to yoke 12 of magnetic circuit 15 near magnetic gap 16 in such a manner as to support the outer periphery of diaphragm 10 through edge 20. To be more specific, the bottom of frame 17 is coupled to the outer periphery of yoke 12, whereas the top of frame 17 is coupled to the outer periphery of diaphragm 10 through edge 20. Voice coil 19 has a first end attached to the reverse side of diaphragm 10, and a second end wound with coil 18 located in magnetic gap 16. The first end of voice coil 19 is coupled to the center of diaphragm 10. Damper 21 is coupled to voice coil 19 and frame 17. Diaphragm 10 may include, in its central region, dust cap 22 to prevent the entry of dust into magnetic gap 16.

The molecular structure of the material composing diaphragm 10 will now be described with reference to FIG. 2.

The material that composes diaphragm 10 contains a main material having molecules 31 and diamondoid derivative 33.

Molecules 31 each have a hydroxyl group. Diamondoid derivative 33 contains molecules each having two or more hydrogen-bonding functional groups. Each of the two or more hydrogen-bonding functional groups in each of the molecules of diamondoid derivative 33 is bonded to the hydroxyl group in each of molecules 31 of the main material of the diaphragm.

The main material of diaphragm 10 is, for example, cellulose and its derivative obtained by beating and separating aggregated fibers of wood or bamboo pulp. Other examples of the main material include chitin, chitosan, and various pulps derived from the following: hemp, paper mulberry, ganpi, paper mulberry, spindle tree, paper bush, flax, cotton, sugar cane, Manila hemp, banana, and oil palm. Thus, molecule 31 has a cellulose skeleton, for example.

Meanwhile, diamondoid derivative 33 has a diamond structure as its main structure. Specific examples of the main structure include an adamantane group, a diamantane group, and a biadamantane group. Adamantane ($C_{10}H_{16}$), which has a diamond monomer structure, is harder and lower in specific gravity than metals. Diamantane ($C_{14}H_{20}$) and biadamantane ($C_{20}H_{30}$) also have similar properties.

These diamondoids are poorly reactive, and this is compensated by using diamondoid derivative 33 whose molecules have hydrogen-bonding functional groups with high affinity for hydroxyl groups. The functional groups of derivative 33 are bonded to hydroxyl groups of molecules 31 of the main material. This improves the modulus of elasticity of diaphragm 10 without significantly increasing its specific gravity. Furthermore, diaphragm 10 can maintain its internal loss because molecules 31 as the main ingredient remain unchanged.

Figure 2:
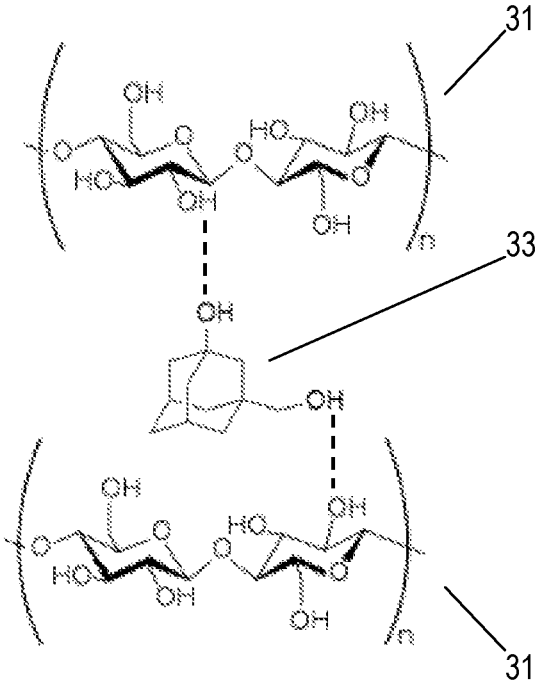
FIG. 2 shows the molecular structure of a material used in the loudspeaker diaphragm shown in FIG. 1.

In FIG. 2, a molecule of diamondoid derivative 33 has hydroxy groups (OH groups) as the two or more hydrogen-bonding functional groups; however the OH groups may be replaced by amide groups, carboxy groups, or epoxy groups. Furthermore, the two or more hydrogen-bonding functional groups may be different from each other. Each of amide groups is represented by a formula of —NRR', where each of R and R' is hydrogen (H) or an alkyl group and R and R' may be the same or different from each other. Each of epoxy groups is represented by a formula as below:

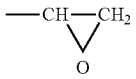

A method of producing diaphragm 10A, which is one example of diaphragm 10, will now be described with reference to FIG. 3.

Figure 3:
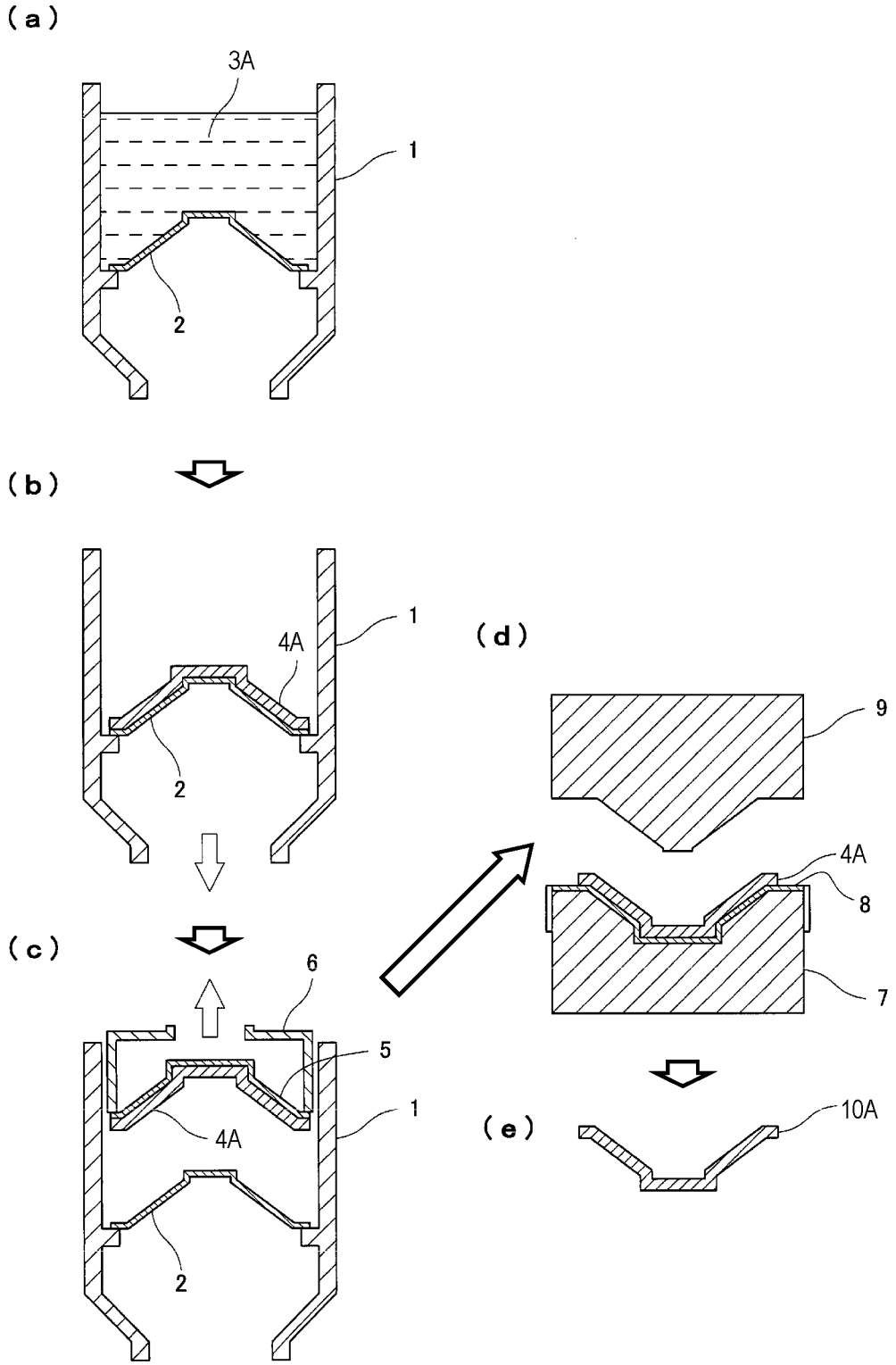
FIG. 3 shows production processes of the loudspeaker diaphragm shown in FIG. 1.

As shown in (a) of FIG. 3, paper-making net 2 is fixed to paper-making bath 1 first, and then paper material 3A is put into bath 1. Paper material 3A has been prepared by dispersing the above-described main material and diamondoid derivative 33 into water. When wood or bamboo pulp is used as the main material, the pulp is put in a beater with at least one of the waterproof agents made of fluorine- and paraffin-based emulsions. Next, the pulp is beaten, while the waterproof agent is adsorbed on the pulp. Furthermore, a resin emulsion may be added to the beater to improve the waterproofness of diaphragm 10A.

Examples of the resin emulsion include epoxy-, acrylic-, and ester-based synthetic resins as a solid component, such as vinyl acetate polymers, acrylic ester copolymers, and ethylene-vinyl acetate-acrylic acid copolymers. The above-mentioned waterproof agent may be replaced by a silicon- or silane-based waterproof agent.

The proportion of the solid content of diamondoid derivative 33 in the solid content of paper material 3A is preferably more than 5 wt % and less than 50 wt %. If the solid content of diamondoid derivative 33 is 5 wt % or less, the modulus of elasticity cannot be well improved. Meanwhile, if the solid content is 50 wt % or more, diaphragm 10A is likely to have cracks during the operation of the loudspeaker including diaphragm 10A.

Next, as shown in (b) of FIG. 3, water is drained from the bottom of bath 1 so as to accumulate paper material 3A in the shape of cone 4A on paper-making net 2. Next, paper-making base 6 on which net 5 is fixed is placed in bath 1.

Subsequently, paper-making base 6 is lowered to suck cone 4A formed on paper-making net 2 through net 5. Next, as shown in (c) of FIG. 3, base 6 is raised to remove and lift cone 4A from net 2.

Next, as shown in (d) of FIG. 3, cone 4A is transferred onto metallic net 8 fixed to mold 7, which is then combined with mold 9 for hot-pressing. Alternatively, cone 4A may be molded with hot air instead of being hot-pressed. This is the completion of diaphragm 10A shown in FIG. 3(*e*).

In diaphragm 10A, some molecules of diamondoid derivative 33 are each bonded to two or more molecules 31 present inside diaphragm 10A, and other molecules of diamondoid derivative 33 are each bonded to two or more molecules 31 present on the surface of diaphragm 10A.

A method of producing diaphragm 10B as another example of diaphragm 10 will now be described with reference to FIG. 4.

Figure 4:
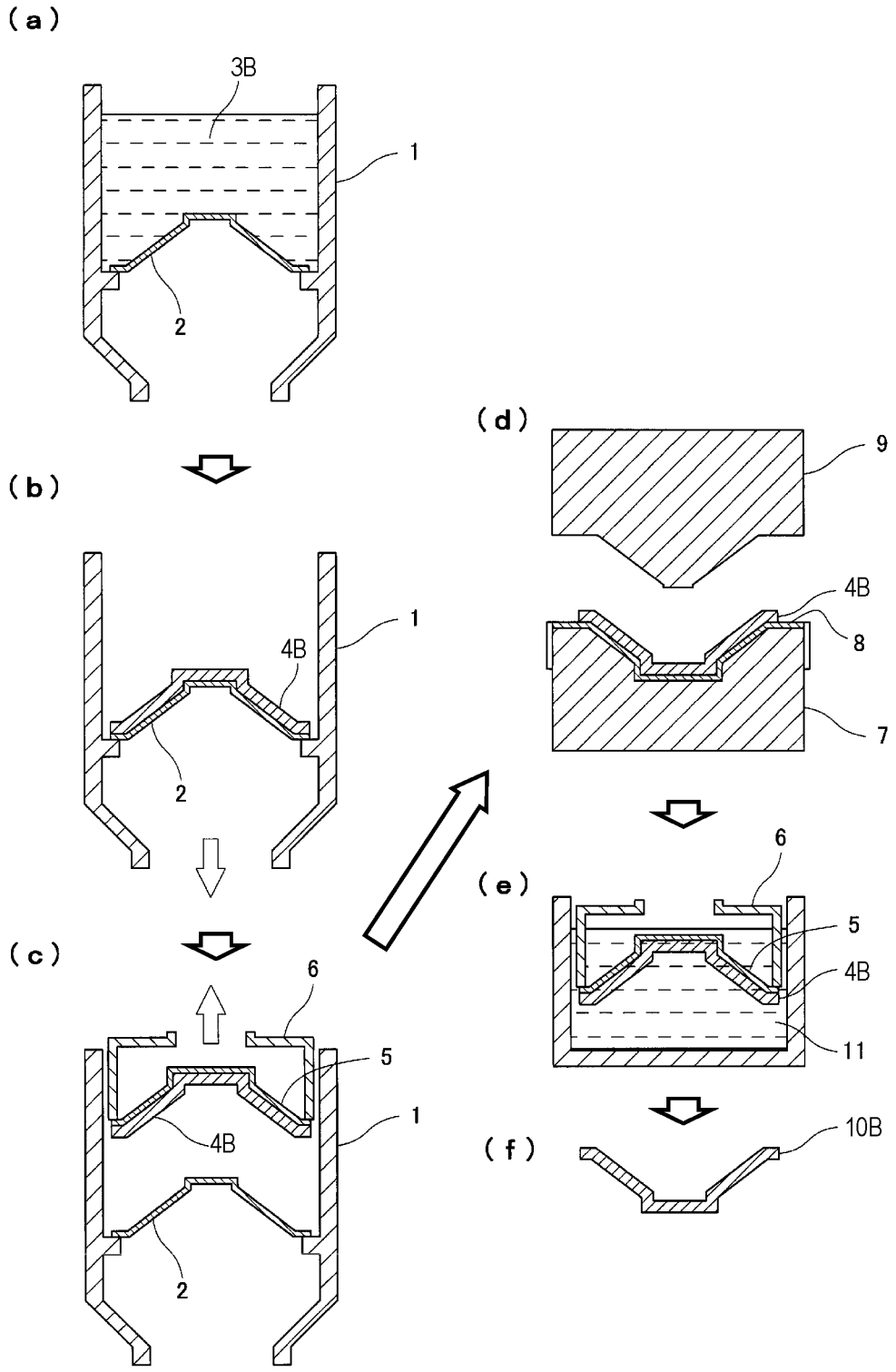
FIG. 4 shows other production processes of the loudspeaker diaphragm shown in FIG. 1.

As shown in (a) of FIG. 4, paper-making net 2 is fixed to paper-making bath 1 first, and then paper material 3B is put into bath 1. Paper material 3B is the same as paper material 3A except for the absence of diamondoid derivative 33.

Next, as shown in (b) of FIG. 4, water is drained from the bottom of bath 1 so as to accumulate paper material 3B in the shape of cone 4B on paper-making net 2. Next, paper-making base 6 on which net 5 is fixed is placed in bath 1.

Subsequently, paper-making base 6 is lowered to suck cone 4B formed on paper-making net 2 through net 5. Next, as shown in (c) of FIG. 4, base 6 is raised to remove and lift cone 4B from net 2.

Next, as shown in (d) of FIG. 4, cone 4B is transferred onto metallic net 8 fixed to mold 7, which is then combined with mold 9 for hot-pressing. Alternatively, cone 4B may be molded with hot air instead of being hot-pressed.

Subsequently, as shown in (e) of FIG. 4, cone 4B is soaked in impregnant 11, which is an alcohol solution containing alcohol-soluble epoxy resin and diamondoid. The preferable ratio of the epoxy resin to the diamondoid in solid content is equal to that in the production method shown in FIG. 3.

Subsequently, cone 4B is taken out of impregnant 11, dried at normal temperature, and heated to thermoset the epoxy resin. Furthermore, a curing agent for the epoxy resin may be added. This is the completion of diaphragm 10B shown in (f) of FIG. 4.

In diaphragm 10B, some molecules of diamondoid derivative 33 are each bonded to two or more molecules 31 present on the surface of diaphragm 10B. Thus, the modulus of elasticity can be sufficiently improved even when molecules of diamondoid derivative 33 are not bonded to molecules 31 deep inside diaphragm 10.

Specific effects of the exemplary embodiment will now be described in the following Examples. In the following description, the main material of the diaphragm is composed of cellulose and its derivative obtained by beating and separating aggregated fibers of wood or bamboo pulp.

Example A

The diaphragm of Example A is produced by the method shown in FIG. 3. The paper material contains the main material, an epoxy resin emulsion (a solid content of 8 wt %), and hydroxymethyl adamantol (a solid content of 10 wt %), which is a diamondoid derivative.

In (d) of FIG. 3, the hot-pressing is performed under the following conditions: a temperature of 200° C., a pressure of 0.2 MPa, and a time of 20 seconds.

The diaphragm of Example A has a modulus of elasticity of 4 GPa and an internal loss of 0.04.

Comparative Example A

The diaphragm of Comparative Example A is produced in the same manner as in Example A except that the paper material does not contain hydroxymethyl adamantol. The diaphragm of Comparative Example A has a modulus of elasticity of 2 GPa and an internal loss of 0.04. The difference in weight between the diaphragms of Example A and of Comparative Example A are within the error range.

A comparison indicates that the diaphragm of Example A including the paper material containing hydroxymethyl adamantol has the same weight but has a higher modulus of elasticity than the diaphragm of Comparative Example A. Hence, a loudspeaker including the diaphragm of Example A can achieve a flat stable frequency response, an increase in the high limit frequency, and high-fidelity reproduction. When the paper material contains hydroxymethyl adamantol, diamondoid molecules containing hydrogen-bonding functional groups are bonded to molecules of the main material.

Example B

The diaphragm of Example B is produced by the method shown in FIG. 4. In short, the diaphragm of Example B includes the same paper material as in Comparative Example A.

In (d) of FIG. 4, the hot-pressing is performed under the following conditions: a temperature of 200° C., a pressure of 0.2 MPa, and a time of 20 seconds.

In the process shown in (e) of FIG. 4, the cone is soaked in an impregnant for ten seconds at normal temperature. The cone is then taken out of the impregnant, dried for 30 minutes at normal temperature, and heated and kept at 120° C. for 30 minutes to thermoset the epoxy resin.

The impregnant is an isopropyl alcohol solution with a solid content of 10 wt % that contained alcohol-soluble epoxy resin and hydroxymethyl adamantol in a ratio of 8:2. Furthermore, 0.5 wt % of an imidazole-based curing agent is added for the epoxy resin. The amount of the impregnant is adjusted in such a manner that the diaphragm contains 20 wt % epoxy resin and 5 wt % hydroxymethyl adamantol.

The diaphragm of Example B has a modulus of elasticity of 4 GPa and an internal loss of 0.04.

Note that the proportion between the alcohol-soluble epoxy resin and the hydroxymethyl adamantol in the impregnant is not limited to 8:2. For example, the impregnant does not have to contain alcohol-soluble epoxy resin as long as it contains hydroxymethyl adamantol. The epoxy resin compensates the brittleness of the diaphragm. Using too much epoxy resin tends to reduce the effect of the adamantane group, making the diaphragm likely to be inflexible. Meanwhile, using too little epoxy resin results in forming a film composed of adamantane alone, making the diaphragm likely to be brittle. Even so, the adamantane molecules are hydrogen-bonded to molecules of the main material, thereby maintaining the film structure. In any case, the proportion of hydroxymethyl adamantol in the diaphragm is preferably more than 5 wt % and less than 50 wt %.

Comparative Example B

The diaphragm of Comparative Example B is produced in the same manner as in Example B except for using an impregnant containing epoxy resin alone (without hydroxymethyl adamantol). The diaphragm of Comparative Example B has a modulus of elasticity of 3 GPa and an internal loss of 0.02. The difference in weight between the diaphragms of Example B and of Comparative Example B is within the error range.

A comparison indicates that the diaphragm of Example B produced using the impregnant containing hydroxymethyl adamantol has the same weight but has a higher modulus of elasticity and internal loss than Comparative Example B. Hence, a loudspeaker including the diaphragm of Example B can achieve a flat stable frequency response, an increase in the high limit frequency, and high-fidelity reproduction.

When a diaphragm is produced using the impregnant that contains hydroxymethyl adamantol, diamondoid molecules containing hydrogen-bonding functional groups are bonded to molecules of the main material present on the surface of the completed diaphragm.

Example C

The diaphragm of Example C is produced by the method shown in FIG. 3 except that the paper material used in the process shown in (a) of FIG. 3 contained adamantanetriol, which has three hydroxyl groups directly bonded to adamantane. The proportion of the adamantanetriol in the paper material is 10 wt %. The diaphragm of Example C has a modulus of elasticity of 4.5 GPa and an internal loss of 0.04.

Example D

The diaphragm of Example D is produced by the method shown in FIG. 4 except that the impregnant used in the process shown in (e) of FIG. 4 contained adamantanetriol instead of hydroxymethyl adamantol. The other ingredients of the impregnant and their proportions are the same as those of the impregnant used in Example B. The diaphragm of Example D has a modulus of elasticity of 4.5 GPa and an internal loss of 0.04.

As described hereinbefore, the present disclosure contributes to improve the performance of a loudspeaker that includes a diaphragm mainly composed of a hydroxyl-group-containing material, such as a cellulose diaphragm. To be more specific, the high modulus of elasticity and high internal loss of the diaphragm enables a loudspeaker to achieve a flat stable frequency response, an increase in the high limit frequency, and high-fidelity reproduction.

What is claimed is:

1. A loudspeaker diaphragm comprising:

a main material comprising molecules each having a hydroxyl group; and a diamondoid derivative comprising molecules each having two or more hydrogen-bonding functional groups, wherein each of the two or more hydrogen-bonding functional groups in each of the molecules of the diamondoid derivative is bonded to the hydroxyl group in each of the molecules of the main material.

2. The loudspeaker diaphragm according to claim 1, wherein one of the molecules of the diamondoid derivative is bonded to two or more molecules on a surface of the loudspeaker diaphragm, among the molecules of the main material.

3. The loudspeaker diaphragm according to claim 2, wherein another one of the molecules of the diamondoid derivative is bonded to two or more molecules inside the loudspeaker diaphragm, among the molecules of the main material.

4. The loudspeaker diaphragm according to claim 1, wherein each of the two or more hydrogen-bonding functional groups is selected from the group consisting of a hydroxyl group, an amide group, a carboxy group, and an epoxy group.

5. The loudspeaker diaphragm according to claim 1, wherein each of the molecules of the diamondoid derivative contains, as a main structure, one of an adamantane group, a diamantane group, and a biadamantane group.

6. A loudspeaker comprising:

the diaphragm according to claim 1;

an edge coupled to an outer periphery of the diaphragm;

a magnetic circuit provided with a magnetic gap, and including a yoke, a magnet, and a plate;

a frame attached to the magnetic circuit, and supporting the outer periphery of the diaphragm via the edge;

a voice coil having a first end attached to the diaphragm and a second end wound with a coil located in the magnetic gap; and a damper coupled to the frame and the voice coil.

* * * * *